US010772805B2

(12) United States Patent
Brady et al.

(10) Patent No.: US 10,772,805 B2
(45) **Date of Patent: *Sep. 15, 2020**

(54) TABLET AND CAPSULE DISPENSING ASSEMBLY

(71) Applicant: Pill Development Group, LLC, Sarasota, FL (US)

(72) Inventors: Robert Owen Brady, Sarasota, FL (US); Joseph B. Bujalski, Advance, NC (US); Jeffery S. Heitzenrater, Spencerport, NY (US); Matthew William Vergin, St. Petersburg, FL (US); Jon Colin Leonard, Sarasota, FL (US); Joel Raymond Chartier, Bradenton, FL (US)

(73) Assignee: Pill Development Group, LLC, Sarasota, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/161,965

(22) Filed: Oct. 16, 2018

(65) Prior Publication Data

US 2019/0046412 A1 Feb. 14, 2019

Related U.S. Application Data

(63) Continuation of application No. PCT/US2017/069049, filed on Dec. 29, 2017.
(Continued)

(51) Int. Cl.
*A61J 7/02* (2006.01)
*A61J 7/04* (2006.01)
(Continued)

(52) U.S. Cl.
CPC ..... *A61J 7/0472* (2013.01); *A61J 1/035* (2013.01); *A61J 7/0076* (2013.01); *A61J 7/0084* (2013.01); *A61J 7/0418* (2015.05); *A61J 7/0445* (2015.05); *A61J 7/0481* (2013.01); *B65D 83/0409* (2013.01); *A61J 7/02* (2013.01);
(Continued)

(58) Field of Classification Search
CPC ..... B65D 83/0454; B65D 83/0463; B65D 2583/0409; A61J 7/04; A61J 1/035
See application file for complete search history.

(56) References Cited

U.S. PATENT DOCUMENTS 3,085,679 A * 4/1963 Burrell ..... B65D 83/0454 206/534
3,393,795 A * 7/1968 Covert, Jr. ..... A61J 7/04 206/534
(Continued)

FOREIGN PATENT DOCUMENTS

GB 1277163 A 6/1972

*Primary Examiner* — Gene O Crawford
*Assistant Examiner* — Ayodeji T Ojofeitimi
(74) *Attorney, Agent, or Firm* — Simpson & Simpson, PLLC; Michael Nicholas Vranjes

(57) ABSTRACT

A tablet and capsule dispensing assembly, comprising a case including an inner circumferential surface having a first plurality of teeth a tablet disc having a plurality of tablets disposed circumferentially thereon, the tablet disc arranged to rotate within the case, and a lock arranged to engage with the first plurality of teeth to prevent rotation of the tablet disc in a first rotational direction during a first predetermined time interval.

20 Claims, 13 Drawing Sheets

Related U.S. Application Data

(60) Provisional application No. 62/440,569, filed on Dec. 30, 2016.

(51) Int. Cl.
*A61J 1/03* (2006.01)
*A61J 7/00* (2006.01)
*B65D 83/04* (2006.01)

(52) U.S. Cl.
CPC ..... *A61J 2200/30* (2013.01); *A61J 2200/70* (2013.01); *A61J 2205/10* (2013.01)

(56) References Cited

U.S. PATENT DOCUMENTS 3,450,306 A * 6/1969 Gill ..... A61J 7/04 221/71
3,870,192 A * 3/1975 Haley ..... A61J 7/04 221/86
4,124,143 A * 11/1978 Thomas ..... B65D 83/0463 206/534
4,165,709 A * 8/1979 Studer ..... B65D 83/0454 116/308
4,646,936 A * 3/1987 Frazier ..... B65D 83/0463 116/308
4,667,845 A * 5/1987 Frazier ..... B65D 83/0463 116/308
4,785,969 A 11/1988 McLaughlin
4,915,256 A * 4/1990 Tump ..... B65D 83/0463 116/308
4,971,221 A * 11/1990 Urquhart ..... B65D 83/0454 221/2
5,409,132 A * 4/1995 Kooijmans ..... A61J 7/04 221/86
5,562,231 A * 10/1996 Lambelet, Jr. ..... B65D 83/0463 221/5
5,775,536 A * 7/1998 Lambelet, Jr. ..... B65D 83/0463 206/531
5,915,589 A 6/1999 Lim
6,021,918 A 2/2000 Dumont et al.
6,039,208 A * 3/2000 Lambelet, Jr. ..... B65D 83/0454 221/197
6,098,835 A 8/2000 DeJonge
6,234,343 B1 * 5/2001 Papp ..... B65D 83/0454 221/197
6,364,155 B1 * 4/2002 Wolfe ..... B65D 83/0454 221/121
6,702,146 B2 3/2004 Varis
7,137,528 B1 * 11/2006 Yates ..... G07F 9/02 221/82
7,366,675 B1 4/2008 Walker et al.
7,444,203 B2 10/2008 Rosenblum
7,471,993 B2 12/2008 Rosenblum
7,661,532 B2 2/2010 Conley et al.
7,774,097 B2 8/2010 Rosenblum
7,801,745 B2 9/2010 Walker et al.
7,896,192 B2 3/2011 Conley et al.
7,978,564 B2 7/2011 De La Huerga
8,033,424 B2 10/2011 Rosenblum
8,069,056 B2 11/2011 Walker et al.
8,286,821 B2 10/2012 Mejia et al.
8,303,500 B2 11/2012 Raheman
8,543,417 B1 9/2013 Jackson
8,622,241 B2 1/2014 Geboers et al.
8,636,172 B2 1/2014 Dunn
8,725,291 B2 5/2014 Czaja et al.
8,744,619 B2 6/2014 Rosenblum
8,751,039 B1 6/2014 Macoviak et al.
9,135,790 B2 9/2015 Wollin
9,218,458 B2 12/2015 Baarman et al.
9,283,150 B2 3/2016 Bujalski et al.
9,361,461 B2 6/2016 Fauci
2002/0026330 A1 2/2002 Klein
2003/0050731 A1 3/2003 Rosenblum
2003/0086338 A1 5/2003 Sastry et al.
2003/0127463 A1 * 7/2003 Varis ..... A61J 7/0084 221/2
2003/0174554 A1 9/2003 Dunstone et al.
2003/0183226 A1 10/2003 Brand et al.
2003/0209558 A1 11/2003 Cross
2004/0035876 A1 * 2/2004 Lo ..... B65D 83/0454 221/25
2004/0172163 A1 9/2004 Varis
2004/0188313 A1 * 9/2004 Tedham ..... B65D 83/0463 206/531
2004/0215369 A1 10/2004 Rosenblum
2005/0049746 A1 3/2005 Rosenblum
2005/0205595 A1 * 9/2005 Lepke ..... B65D 83/0454 221/87
2005/0258182 A1 * 11/2005 Anderson ..... A61M 15/0045 221/7
2006/0180600 A1 8/2006 Talyor
2006/0218014 A1 9/2006 Walker et al.
2006/0218015 A1 9/2006 Walker et al.
2007/0073560 A1 3/2007 Walker et al.
2007/0156282 A1 7/2007 Dunn
2007/0163583 A1 7/2007 Brand et al.
2007/0260491 A1 11/2007 Palmer et al.
2007/0271001 A1 11/2007 Ratnakar
2007/0293982 A1 12/2007 Rosenblum
2007/0295742 A1 * 12/2007 Kheiri ..... G01N 33/4875 221/25
2008/0030309 A1 2/2008 Darrouzet
2008/0032407 A1 * 2/2008 Brown ..... G01N 33/4875 436/46
2008/0077440 A1 3/2008 Doron
2008/0173666 A1 * 7/2008 Coe ..... B65D 83/0409 221/265
2008/0210701 A1 9/2008 Cooper
2008/0283542 A1 11/2008 Lanka et al.
2009/0048712 A1 2/2009 Rosenblum
2009/0164238 A1 6/2009 Auchinleck
2009/0294521 A1 12/2009 de la Huerga
2010/0100237 A1 4/2010 Ratnakar
2010/0228141 A1 9/2010 Kountotsis
2010/0318218 A1 12/2010 Muncy, Jr. et al.
2010/0324728 A1 12/2010 Rosenblum
2011/0036803 A1 2/2011 Mejia et al.
2011/0060457 A1 3/2011 De Vrught et al.
2011/0125317 A1 5/2011 Dunn
2011/0125318 A1 5/2011 Dunn
2011/0166700 A1 7/2011 Dunn
2011/0270442 A1 11/2011 Conley et al.
2012/0003928 A1 1/2012 Geboers et al.
2012/0006700 A1 1/2012 Geboers et al.
2012/0065776 A1 3/2012 Czaja et al.
2012/0089249 A1 4/2012 Rosenblum
2012/0101630 A1 4/2012 Daya et al.
2012/0165975 A1 6/2012 Yi et al.
2013/0088328 A1 4/2013 DiMartino et al.
2013/0090594 A1 4/2013 Palmer et al.
2013/0110283 A1 5/2013 Baarman et al.
2013/0116818 A1 * 5/2013 Hamilton ..... A61J 7/04 700/236
2013/0134180 A1 5/2013 Cheyene
2013/0166066 A1 6/2013 Dunn
2013/0197693 A1 8/2013 Kamen et al.
2013/0256331 A1 * 10/2013 Giraud ..... B65D 83/0409 221/1
2013/0261794 A1 10/2013 Fauci
2013/0304255 A1 11/2013 Ratnakar
2013/0317645 A1 11/2013 Daya et al.
2014/0052468 A1 2/2014 Burrows et al.
2014/0058559 A1 2/2014 Haynes
2014/0207278 A1 7/2014 Czaja et al.
2014/0214200 A1 7/2014 Chrusciel et al.
2014/0239062 A1 8/2014 Nurse et al.
2014/0244031 A1 8/2014 Macoviak et al.
2014/0263425 A1 9/2014 Akdogan et al.
2014/0277705 A1 9/2014 Czaja et al.
2014/0277707 A1 9/2014 Akdogan et al.

(56) References Cited

U.S. PATENT DOCUMENTS

| | | | | |
|---|---|---|---|---|
| 2014/0324216 | A1 | 10/2014 | Beg et al. | |
| 2014/0326744 | A1 | 11/2014 | Ratnakar | |
| 2014/0339248 | A1 | 11/2014 | Reddy et al. | |
| 2014/0339249 | A1 | 11/2014 | Reddy et al. | |
| 2014/0346186 | A1 | 11/2014 | Reddy et al. | |
| 2014/0372144 | A1 | 12/2014 | Sterns et al. | |
| 2015/0025679 | A1 | 1/2015 | Rosenblum | |
| 2015/0048101 | A1 | 2/2015 | Reddy et al. | |
| 2015/0061832 | A1 | 3/2015 | Pavlovic et al. | |
| 2015/0145672 | A1 | 5/2015 | Chu | |
| 2015/0161558 | A1 | 6/2015 | Gitchell et al. | |
| 2015/0254427 | A1 | 9/2015 | Burrows et al. | |
| 2015/0272825 | A1 | 10/2015 | Lim et al. | |
| 2015/0284174 | A1* | 10/2015 | Vogels ..... | B65D 83/0445 221/1 |
| 2015/0294551 | A1 | 10/2015 | Edwards et al. | |
| 2015/0310185 | A1 | 10/2015 | Shah | |
| 2015/0310186 | A1 | 10/2015 | Conley et al. | |
| 2015/0317455 | A1 | 11/2015 | Lehmann et al. | |
| 2015/0343144 | A1 | 12/2015 | Altschul et al. | |
| 2015/0360834 | A1 | 12/2015 | Mikhail | |
| 2016/0031620 | A1 | 2/2016 | Rosenquist | |
| 2016/0081882 | A1 | 3/2016 | Joyce et al. | |
| 2016/0085938 | A1 | 3/2016 | Hans | |
| 2016/0128906 | A1 | 5/2016 | Baarman et al. | |
| 2016/0158107 | A1 | 6/2016 | Dvorak et al. | |
| 2016/0203292 | A1 | 7/2016 | Kamen et al. | |
| 2016/0247345 | A1 | 8/2016 | Ratnakar | |

* cited by examiner

TABLET AND CAPSULE DISPENSING ASSEMBLY

CROSS-REFERENCE TO RELATED APPLICATIONS

This application is filed under 35 U.S.C. §§ 111(a) and 365(*c*) as a continuation of International Patent Application No. PCT/US17/69049, filed Dec. 29, 2017, which application claims the benefit under 35 U.S.C. § 119(e) of U.S. Provisional Patent Application No. 62/440,569, filed on Dec. 30, 2016, which applications are herein incorporated by reference in their entireties.

FIELD

The disclosure relates to tablet and capsule dispensers, more particularly to tablet and capsule dispensers that dispense tablets and capsules in compliance with a predefined regimen specific to a time interval or schedule, and, even more specifically, to a tablet and capsule dispensers that prevent access to tablets and capsules except as specified by a pre-defined regimen.

BACKGROUND

Opioids are a type of medicine often used to help relieve pain. Opioids work by attaching themselves to specific proteins called opioid receptors, which are found in nerve cells in the brain, spinal cord, gastrointestinal tract, and other organs within the human body. When opiates attached to these receptors, they change how the brain perceives pain by creating feelings of pleasure and euphoria. The human brain is wired to record feelings of pleasure and euphoria, and cues the individual to take more and more of the drug. As a result, a user can become dependent on, and addicted to, opioids very quickly. Current estimates show that as many as 36 million users worldwide suffer from opioid addiction.

Opioid addiction quickly leads to adverse health effects such as dizziness, nausea, aches and pains, tremors, chills, vomiting, and constipation. In addition to these negative health effects, the user builds a tolerance to the positive effects of the opioid which can lead to overdose and death. In 2015, the Centers for Disease Control reported that drug overdoses accounted for 52,504 deaths in the United States, 63.1% of which involved and opioid.

As a result of the increased levels of addiction, prescription medications are typically controlled in a closed system of distribution which seeks to control the importation, manufacture, distribution, and dispensing of controlled substances. This closed system is designed to provide a discrete chain of custody for controlled substances, and ensure that those substances are used in accordance with a prescribed manner which is specific to a given quantity of the substance taken at defined intervals of time. This closed system effectively opens when a controlled substance is released into the hands of the patient or end-user. The end-user, while bound by the laws of use specified by the closed system, is largely free to operate on the honor system and trusted to follow the regimen specified by the prescription instructions.

Several unintended consequences arise from this honor system which include, but are not limited to; missed doses, over-doses, unused quantities of controlled substances, and access to controlled substances by non-authorized users. Further, well-meaning end-users often dispose of unused quantities of controlled substances into the wastewater supply where they contaminate water resources with unknown and poorly-studied consequences.

In the case of addictive substances such as opioids, an attractive nuisance is created whereby unauthorized users happen upon and ingest unused controlled substances and experience the euphoria associated with opioids and other strong pain medications. For many, this first experience leads to a downward spiral of abuse which tragically, and all too often, results in addiction, and a move to cheaper, more readily accessible street drugs like heroin. Deaths related to heroin and opioid abuse continue to spiral out of control, due in part, to the lack of control resulting from the current honor system of managing the distribution of controlled substances to end-users.

U.S. Pat. No. 7,978,5464 (De La Huerga) discloses a device which relies upon an electronic processor and communication with the end-user to remind of the proper dose, track usage, warn of drug interactions, but does not physically limit access to controlled substances. A further disadvantage of the device in De La Huerga is that the device relies upon separate consoles which would complicate adherence to regimens for end-users who are traveling or simply going about their daily lives, going to the market, or even visiting their physician.

U.S. Pat. No. 9,218,458 (Baarman) discloses another device that tracks usage, reminds and warns end users, using an additional electronic device in proximity with the invention before dispensing controlled substances. While this device moves to physically limit access, it requires an outboard device for user validation. Further, the invention automatically dispenses controlled substances according to a pre-defined regimen, but this may conflict with regimen instructions such as, "take as needed", or, "take one or two tablets, as needed."

United States Patent Application Publication No. 2014/0214200 (Chrusciel) controls dispensing "several non-individually packaged pills at a plurality of times". The nature of providing for a "plurality of removable magazines" results in a device that is much larger than is conveniently portable and requires an end-user to move all of their controlled substances about as a single group. The use of rechargeable batteries, charged from a wall outlet further restricts portability.

U.S. Pat. No. 8,622,241 (Geboers) describes a device where tablets or capsules are dispensed at preset intervals and quantities from columns of loose tablets, pills or capsules. The device is mechanical, or electromechanical, but requires an outboard unit containing a processor and communication device to track end-user behavior and to respond to flexible requirements embodied in many medication regimens.

U.S. Pat. No. 9,283,150 (Bujalski) describes a device that relies upon a mechanical timer to release controlled substances in accordance with a pre-defined regimen. End-users are alerted when the time interval is reached, but there is limited flexibility in managing instructions such as, "Take one or two tablets as needed". This invention lacks the ability to record and communicate a history of usage, and the ability to display remaining dosages, or time to next dosage.

Thus, there is a long-felt need for a tablet and capsule dispenser that prevents access to tablets and capsules except as specified by a pre-defined regimen and has the ability to record and communicate a history of usage, display remaining dosages, display time to next dosage, and prevent early access to the next dosage.

SUMMARY

According to aspects illustrated herein, there is provided a tablet and capsule dispensing assembly, comprising a case including an inner circumferential surface having a first plurality of teeth a tablet disc having a plurality of tablets disposed circumferentially thereon, the tablet disc arranged to rotate about a central axis and within the case, and a lock arranged to engage with the first plurality of teeth to prevent rotation of the tablet disc in a first rotational direction during a first predetermined time interval.

According to aspects illustrated herein, there is provided a tablet and capsule dispensing assembly, comprising a case including a superior component having a first aperture, and an inferior component arranged to engage with the superior component forming a first cavity therebetween, the inferior component having a second aperture, a tablet disc having a plurality of tablets disposed circumferentially thereon, the tablet disc arranged to rotate within the case, wherein the first aperture and the second aperture are arranged to, when aligned, allow a first tablet of the plurality of tablets to be removed from the tablet disc, and a lock arranged prevent rotation of the tablet disc in a first rotational direction during a first predetermined time interval.

According to aspects illustrated herein, there is provided a tablet and capsule dispensing assembly including a case, the case having an inner circumferential surface, the inner circumferential surface having a first plurality of teeth, a tablet disc having a plurality of tablets disposed about a circumference of the tablet disc, the tablet disc arranged to rotate about a central axis and within the case, and a lock arranged to engage with the first plurality of teeth to prevent rotation of the tablet disc in a first rotational direction at a first predetermined time interval.

According to aspects illustrated herein, there is provided a tablet and capsule dispensing assembly, including a case having a superior component and an inferior component operatively arranged to form a first cavity therebetween, a tablet disc arranged within the first cavity, the tablet disc having a plurality of tablets disposed about a circumference of the tablet disc, and arranged to rotate about a central axis and within the case, and a lock arranged to prevent rotation of the tablet disc in a first rotational direction at a first predetermined time interval. The lock further includes a first component and a second component. The first component including a display and a first circuit electrically connected to the display. The second component including a solenoid actuator, a pivotable catch, a second plurality of teeth disposed on an outer circumferential surface of the second component, and a ratchet operatively arranged to engage with the second plurality of teeth and the case.

These and other objects, features, and advantages of the present disclosure will become readily apparent upon a review of the following detailed description of the disclosure, in view of the drawings and appended claims.

BRIEF DESCRIPTION OF THE SEVERAL VIEWS OF THE DRAWINGS

Various embodiments are disclosed, by way of example only, with reference to the accompanying schematic drawings in which corresponding reference symbols indicate corresponding parts, in which.

DETAILED DESCRIPTION OF EMBODIMENTS

Figure 1A:
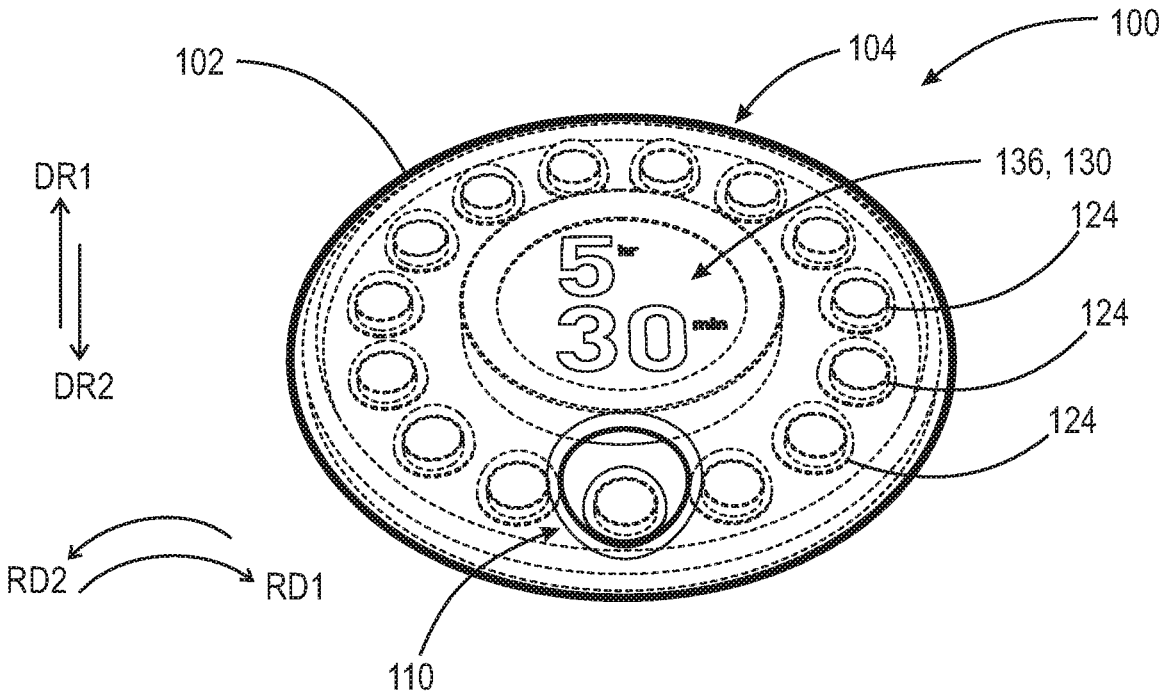
FIG. 1A is a front perspective view of the top of the dispensing assembly as disclosed herein.
Figure 1B:
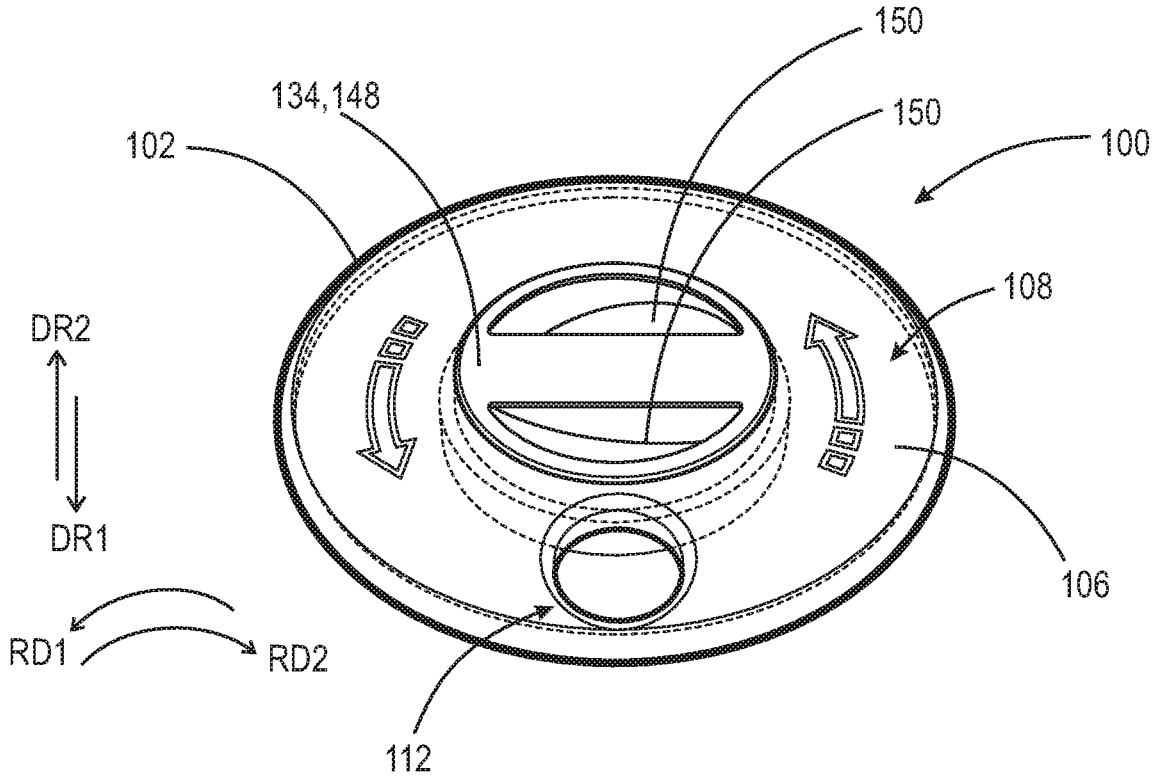
FIG. 1B is a front perspective view of the bottom of the dispensing assembly as disclosed herein.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" or "non-rotatably secured" elements, we mean that: the elements are connected so that whenever one of the elements rotate, all the elements rotate; and relative rotation between the elements is not possible. Radial and/or axial movement of non-rotatably connected elements with respect to each other is possible, but not required. By "rotatably connected" elements, we mean that the elements are rotatable with respect to each other.

Moreover, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

The term "Superior Component" as used in the present disclosure is intended to mean the component of the case located in the highest position relative to the inferior component component in first direction DR1.

The term "Inferior Component" as used in the present disclosure is intended to mean the component of the case located in the lowest position relative to the superior component in first direction DR1.

Adverting now to the figures, FIGS. 1A-2B illustrate various perspective views of dispensing assembly 100 in an assembled state and an exploded state. Dispensing assembly 100 includes case 102 which is substantially toroidal in shape. Case 102 includes superior component 104 and inferior component 106. Superior component 104 and inferior component 106 are arranged to engage via a press-fit, friction-fit, or interference-fit, leaving a substantially toroidal first cavity 108 therebetween. It is intended that superior component 104 and inferior component 106 are arranged such that once they are fitted together, no user can open the case, e.g., only a manufacturer or healthcare professional may separate the components. In an example embodiment, superior component 104 and inferior component 106 are made of high impact modified Poly(methyl methacrylate) (PMMA); however, it should be appreciated that any other durable material can be used, e.g., high-density polyethylene, low-density polyethylene, metal, high-impact polystyrene, Polycarbonate (PC), Polyether Imide (PEI), or any other material which can resist breaking or cracking while in use, and prevent tampering and/or render evident any tampering caused by the user. Superior component 104 further includes aperture 110, and inferior component 106 further includes aperture 112. Apertures 110 and 112 are arranged such that when case 102 is assembled, aperture 110 of superior component 104 is aligned with, and directly above, aperture 112 of inferior component 106. Superior component also includes first rim 114 (shown in FIG. 2B) which contains first plurality of teeth 116 disposed about a circumferential surface of first rim 114 and operatively arranged to engage with pivotable catch 152 discussed infra. Inferior component 106 further comprises opening 118 operatively arranged to receive second component 134 of lock 130 discussed infra; and, second rim 120 (shown in FIG. 2A) arranged to engage with lock 130 discussed infra.

Dispensing assembly 100 further comprises tablet disc 122. Tablet disc 122 and lock 130 (discussed infra) are positioned within first cavity 108 of case 102 when dispensing assembly 100 is completely assembled. Tablet disc 122 further comprises plurality of tablets 124 disposed about the circumference of tablet disc 122. The tablets of plurality of tablets 124 are set apart from each other a fixed circumferential distance such that they are evenly spaced. In an example embodiment, tablet disc 122 is a prefabricated blister pack with a plurality of individual cells which isolate a single dose of a particular medication, i.e., each tablet is intended to be a single dose of a particular medication. The distance between each tablet or cell and the size of apertures 110 and 112 are proportional such that access to tablets is limited to one tablet at a time through apertures 110 and 112. Tablet disc 122 further comprises first through-bore 126 arranged to engage with first projection 140 (discussed infra) and at least one second through-bore 128 arranged to engage with at least one second projection 146 (not shown and discussed infra).

Dispensing assembly 100 further comprises lock 130. Lock 130 comprises first component 132 and second component 134. First component 132 comprises display 136, and first circuit 138 (shown in FIG. 3). In an example embodiment, display 136 is an E-ink display; however, it should be appreciated that other displays are possible, e.g., a touch-screen display, an Light-Emitting Diode (LED) display, an Electroluminescent (ELD) display, a Plasma Display Panel (PDP) display, an Organic Light-Emitting Diode (OLED) display, a Liquid Crystal (LCD) display, or other equivalent displays. Display 136 is arranged to display the current state of dispensing assembly 100 and show the time interval remaining until tablet disc 122 can be rotated to the next position (description of use of the assembly described infra). Second component 134 comprises, first projection 140 having first surface 142, second cavity 144, at least one second projection 146 (not shown), second surface 148 having a plurality of grips 150, solenoid actuator 152, pivotable catch 154, second plurality of teeth 156, and ratchet 158.

First projection 140 is a substantially cylindrical protrusion arranged to be concentric with second component 134 and further comprises second plurality of teeth 156. Second plurality of teeth 156 are operatively arranged on the outer circumference of first projection 140 and arranged to engage with ratchet 158. First projection 140 further includes first surface 142. First surface 142 comprises at least one second projection 146 (not shown) and second cavity 144. At least one second projection 146 is a peg or other projection operatively arranged to protrude in first direction DR1 with respect to first surface 142 and engage with through-bores 128 of tablet disc 122. When completely assembled, first projection 140 and at least one second projection 146 slide within, and engage with, first through-bore 126 and at least one second through-bore 128 of tablet disc 122, respectively. Second cavity 144 is arranged to receive solenoid actuator 152 when dispensing assembly 100 is fully assembled. Second surface 148, which is arranged opposite first surface 142 on second component 134, includes plurality of grips 150. Plurality of grips 150 are illustrated as two quadraspherical (one quarter of a sphere) cavities separated by a portion of second component 134; however, it should be appreciated that any physical arrangement that allows for a user to provide sufficient torque on lock 130 to rotate second component 134 relative to first component 132 can be used. Plurality of grips 150 are arranged such that a user can grip and provide a rotational force in first rotational direction RIM or second rotational direction RD2 when a new tablet/pill is needed.

Figure 2A:
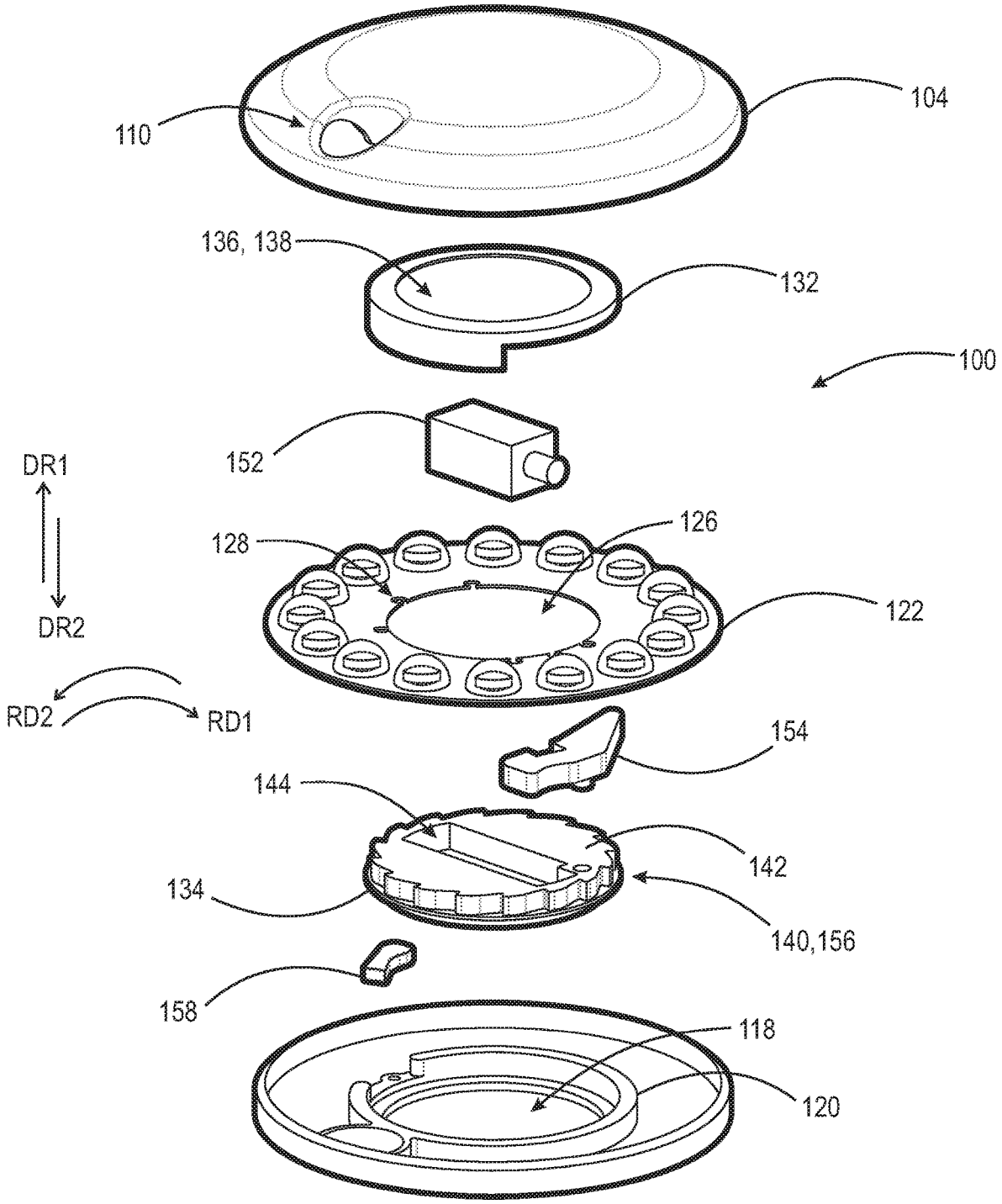
FIG. 2A is a front perspective exploded view of the dispensing assembly of FIG. 1A.
Figure 2B:
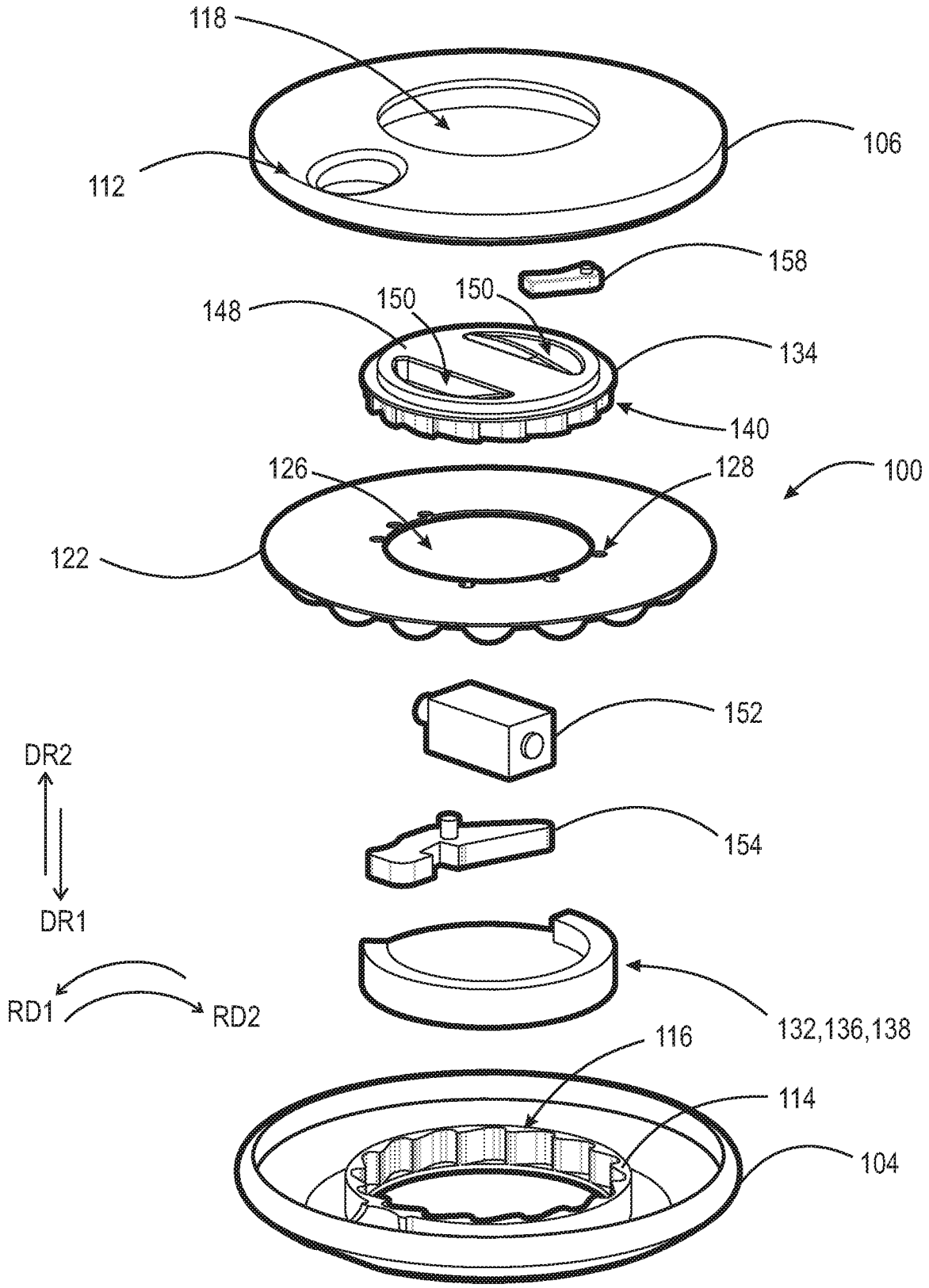
FIG. 2B is a front perspective exploded view of the dispensing assembly of FIG. 1B.
Figure 8:
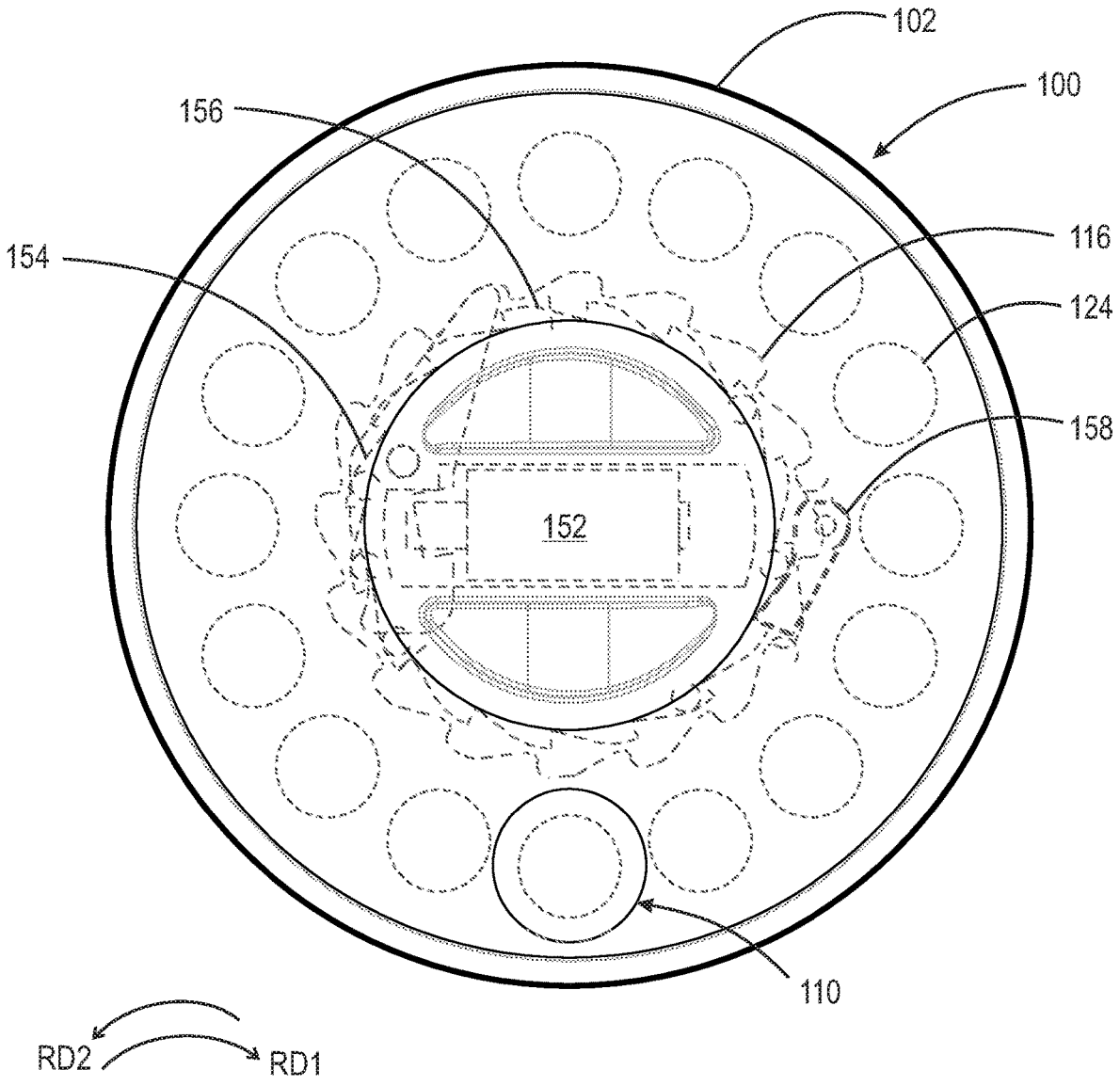

It should be appreciated that first plurality of teeth 116 and second plurality of teeth 156 can be angled such that they prevent rotational motion of tablet disc 122 in either first rotational direction RIM or second rotational direction RD2. For example, FIGS. 1A, 1B, and 4A-5C illustrate arrangements where ratchet 158 prevents rotational motion in rotational direction RD2 and pivotable catch 154 prevents and/or allows for rotational motion of tablet disc 122 in first rotational direction RD1. However, it should be appreciated that, as shown in FIGS. 2A, 2B and 8, first plurality of teeth 116 and second plurality of teeth 156 can be angled such that ratchet 158 prevents rotational motion of tablet disc 122 in first rotational direction RD1 and pivotable catch 154 prevents and/or allows for rotational motion of tablet disc 122 in second rotational direction RD2.

Solenoid actuator 152 is operatively arranged to sit within second cavity 144 and engage with pivotable catch 154 causing pivotable catch 154 to pivot and engage and/or disengage with first plurality of teeth 116 of superior component 104. As illustrated in FIGS. 1A, 1B, and 4A-5C, when solenoid actuator 152 is disengaged, tablet disc 122 is prevented from rotating in a first rotational direction RIM and second rotational direction RD2. When solenoid actuator 152 is engaged, i.e., extended, tablet disc 122 is free to rotate in first rotational direction RIM. It should be appreciated that any actuator known in the art can be used to engage with first plurality of teeth 116. Pivotable catch 154 has a peg which rotatably engages with a partial through-bore disposed within first surface 142 of second component 134 such that it can pivot when engaged with solenoid actuator 152. First plurality of teeth 116 and pivotable catch 154 are arranged such that they are not affected by vibrations or gyrations which could be experienced in the average use of the assembly.

It should be appreciated that second component 134 is operatively arranged to sit within, and rotate independently from, first component 132. First component 132 is intended to remain non-rotatably secured to superior component 104 such that, when tablet disc 124 and second component 134 rotate in second rotational direction RD2, first component 132, which contains display 136, remains rotationally locked in case 102. This ensures that the display is always visible from the side of dispensing assembly 100 that comprises apertures 110 and 112. Additionally, as solenoid actuator 152 must be permitted to rotate with second component 134 while simultaneously maintaining electronic communication with first circuit 138, solenoid actuator 152 can be electrically connected to first circuit 138 with any wired or wireless circuit capable of transferring electricity to a rotating body, e.g., electrical slip rings, pancake slip rings, wireless slip rings, wireless power transfer circuits, inductive power transfer circuits, etc.

Figure 3:
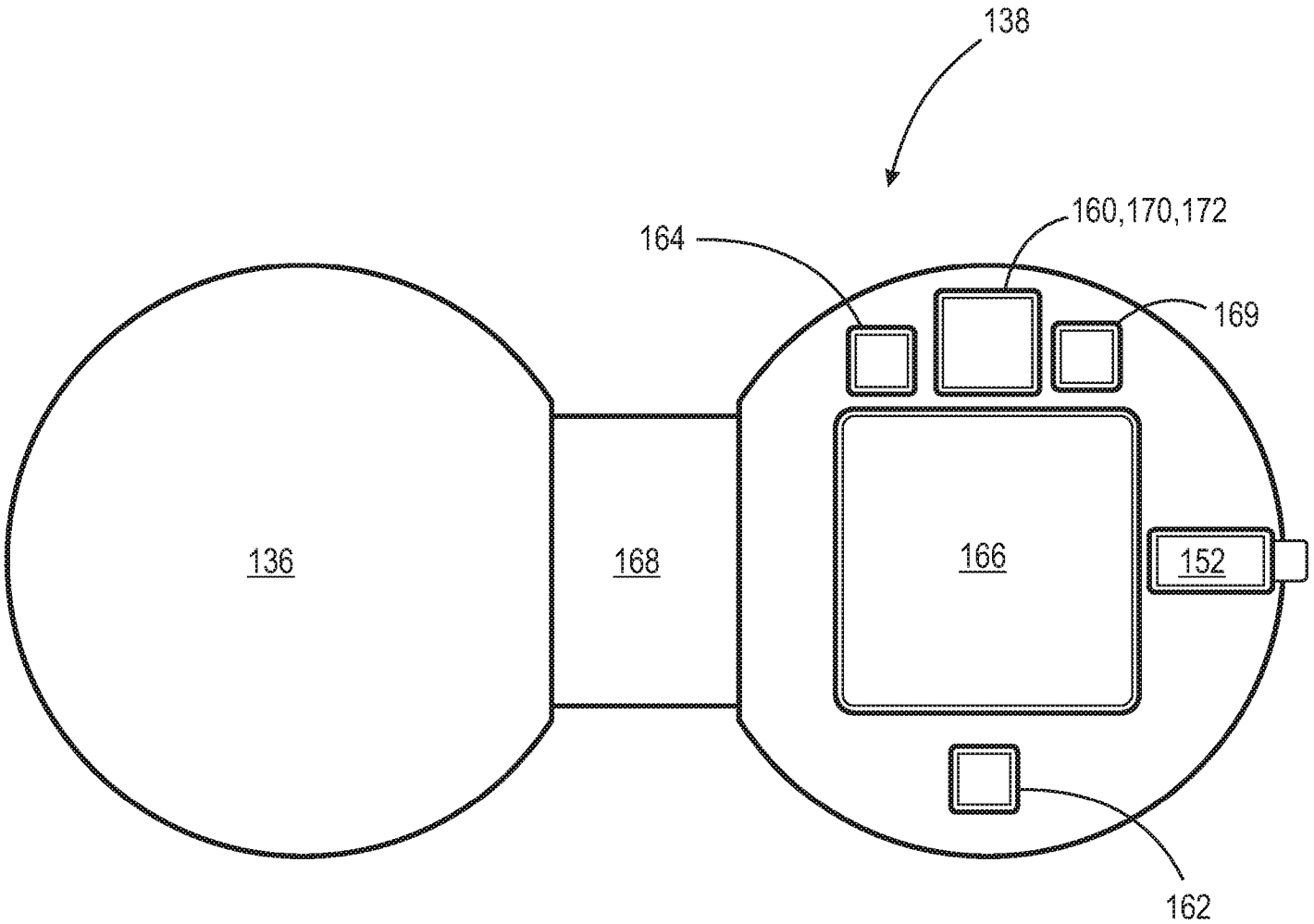
FIG. 3 is a high-level schematic view of a circuit associated with the dispensing assembly as disclosed herein.

FIG. 3 illustrates a high-level schematic view of first circuit 138. First circuit 138 comprises microcontroller 160, timer 162, antenna 164, power supply 166, and flex circuit 168, and sensor 169. Microcontroller 160 further includes processor 170 and memory 172, which are operatively arranged to store and execute a set of non-transitory computer readable instructions. Memory 172 can store a first data set comprised of at least one date, at least one time, a rotational position of the tablet disc, and an integer. The date, time, and integer can reflect the history of a user's interaction with dispensing assembly 100 and keep track of which pill/tablet was accessed at what time. In an example embodiment, microcontroller 160 is a Cypress Semiconductor part no.: CY8C4247LQI-BL483 available from Mouser Electronics; however, it should be appreciated that any other suitable microcontroller could be used to store the set of non-transitory computer readable instructions and first data set.

Timer 162 is a simple circuit operatively arranged to provide a base time signal to a microcontroller. This circuit comprises, for example, a crystal quartz oscillator. In an example embodiment timer 162 is a crystal oscillator part no.: ECS-240-8-36CKM available from ECS Inc.; however, it should be appreciated that any crystal oscillator that can communicate with microcontroller 160 and keep time can be utilized. Antenna 164 is operatively arranged to communicate with microcontroller 160 and can be utilized to send/receive a wireless signal/communication. It should be appreciated that "wireless communication(s)" as used herein is intended to mean Radio Frequency Identification (RFID) communication, Bluetooth® protocols, Near field Communication (NFC), Near Field Magnetic Inductance Communication (NFMIC), Wi-Fi, LTE, Airdrop® communication, or any other wireless protocol sufficient to communicate with microcontroller 160. Additionally, display 136 is capable of rendering a visible image, e.g., a bar code or QR code, which can be scanned by an external device as a means for transmitting information from dispensing assembly 100. In an example embodiment antenna 164 is part no.: 2450AT42E0100 available from Johanson Technology Inc.; however it should be appreciated that any antenna capable of communication via the above-identified protocols can be used. Power supply 166 is intended to be a battery or any combination of multiple batteries that can produce sufficient voltage to power the components in first circuit 138, solenoid actuator 152, and display 136. Flex circuit 168 is a flexible ribbon-type circuit that is operatively arranged to bend and flex such that electrical current may still flow from microcontroller 160 to display 136. Furthermore, sensor 169 is arranged to sense and store the rotational position of tablet disc 122. It should be appreciated that a sensor 169 could be embodied as an optical sensor, limit-switch, or other device capable of sensing a position of tablet disc 122 can be included in first circuit 138.

Figure 4A:
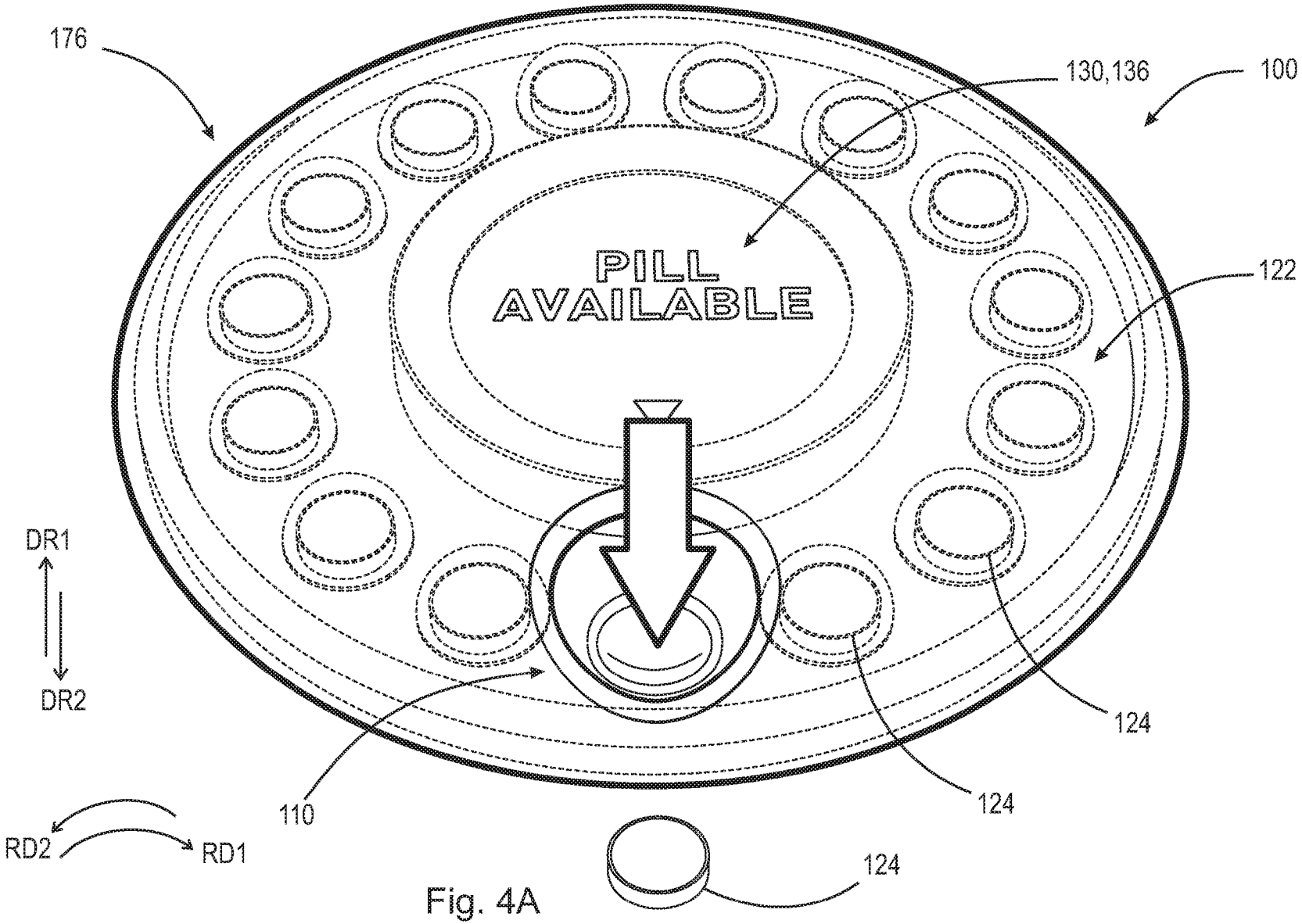
FIG. 4A is a front perspective view of the top of the dispensing assembly as disclosed herein.
Figure 4B:
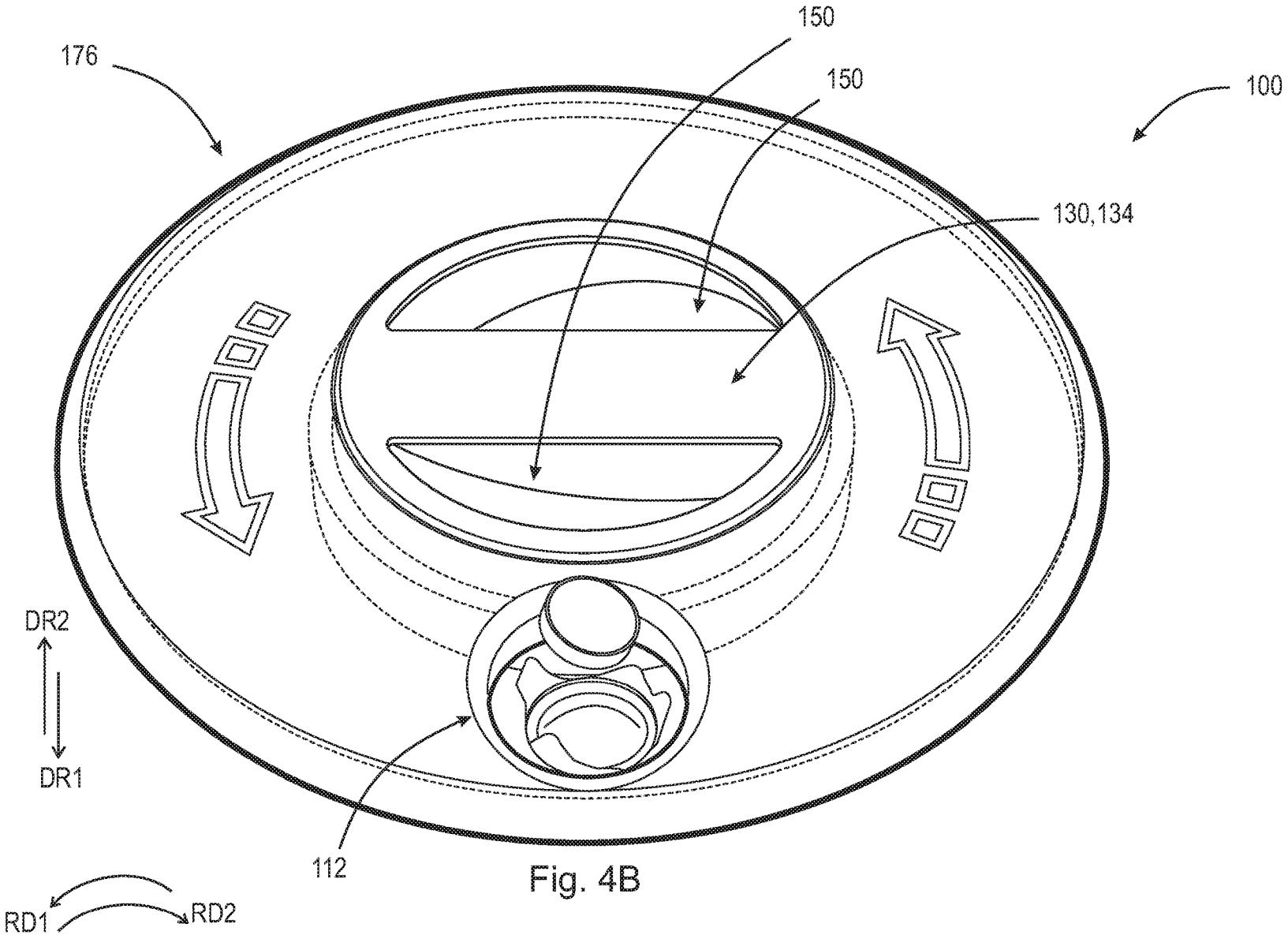
FIG. 4B is a front perspective view of the bottom of the dispensing assembly as disclosed herein.

The following description is intended to illustrate one potential operation of dispensing assembly 100 and should be read in view of FIGS. 4A-5C. Initially, a user will receive dispensing assembly 100 from the manufacturer, pharmacist, or other healthcare professional. The dispensing assembly will come pre-assembled and closed as illustrated in FIGS. 4A and 4B. In initial position 176, one tablet of plurality of tablets 124 is aligned with first aperture 110 and second aperture 112 and can be depressed and removed from tablet disc 122 by the user. Additionally, in initial position 176, display 136 indicates that the first tablet, aligned with apertures 110 and 112, is available for dispensing. Once the first tablet of plurality of tablets 124 is dispensed, the user can ingest the tablet. In initial position 176, ratchet 158 (shown in FIGS. 2A and 2B), which is pivotably mounted on second rim 120 (shown in FIG. 2A) of inferior component 106, is spring loaded such that it is engaged with one of the second plurality of teeth 156 (shown in FIG. 2A) of second component 134 preventing rotation of lock 130 in second rotational direction RD2. Second plurality of teeth 156 and ratchet 158 are arranged such that they are not affected by vibrations or gyrations which could be experience in the average use of the assembly. Additionally, in initial position 176 solenoid actuator 152 (shown in FIGS. 2A and 2B) is in an activated state, i.e., positioned such that the plunger is in an extended position. In this extended position, solenoid actuator 152 engages with pivotable catch 154 (shown in FIGS. 2A and 2B). Pivotable catch 154 pivots about a peg or other protrusion which is disposed within a third cavity on first surface 142 (shown in FIG. 2A) of first projection 140 (shown in FIG. 2A) of second component 134. In this state, pivotable catch 154 is not engaged with first plurality of teeth 116 (shown in FIG. 2B) of superior component 104, and second component 134 and tablet disc 122 are free to rotate in second rotational direction RD2.

Figure 5A:
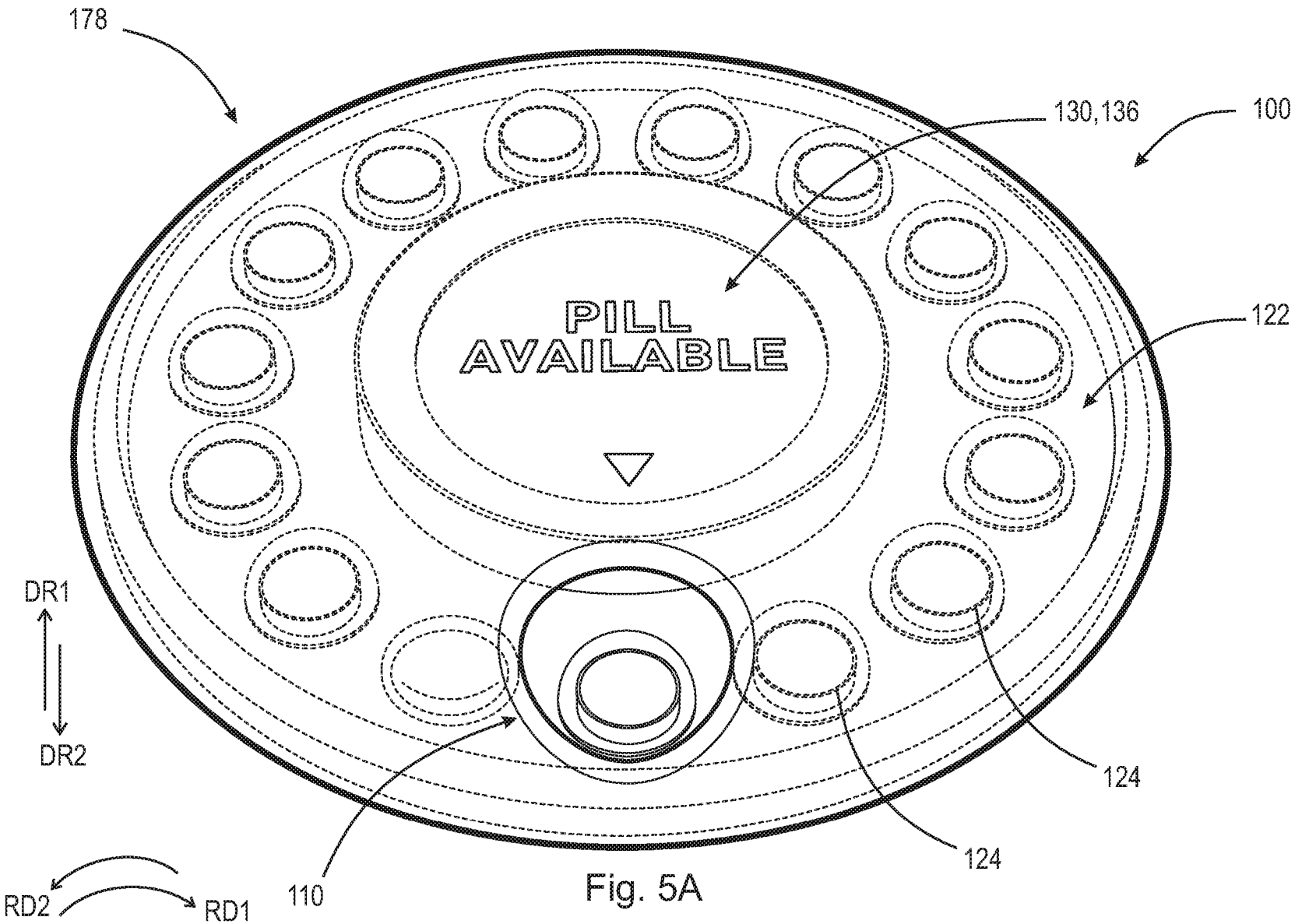
FIG. 5A is a front perspective view of the top of the dispensing assembly as disclosed herein.
Figure 5B:
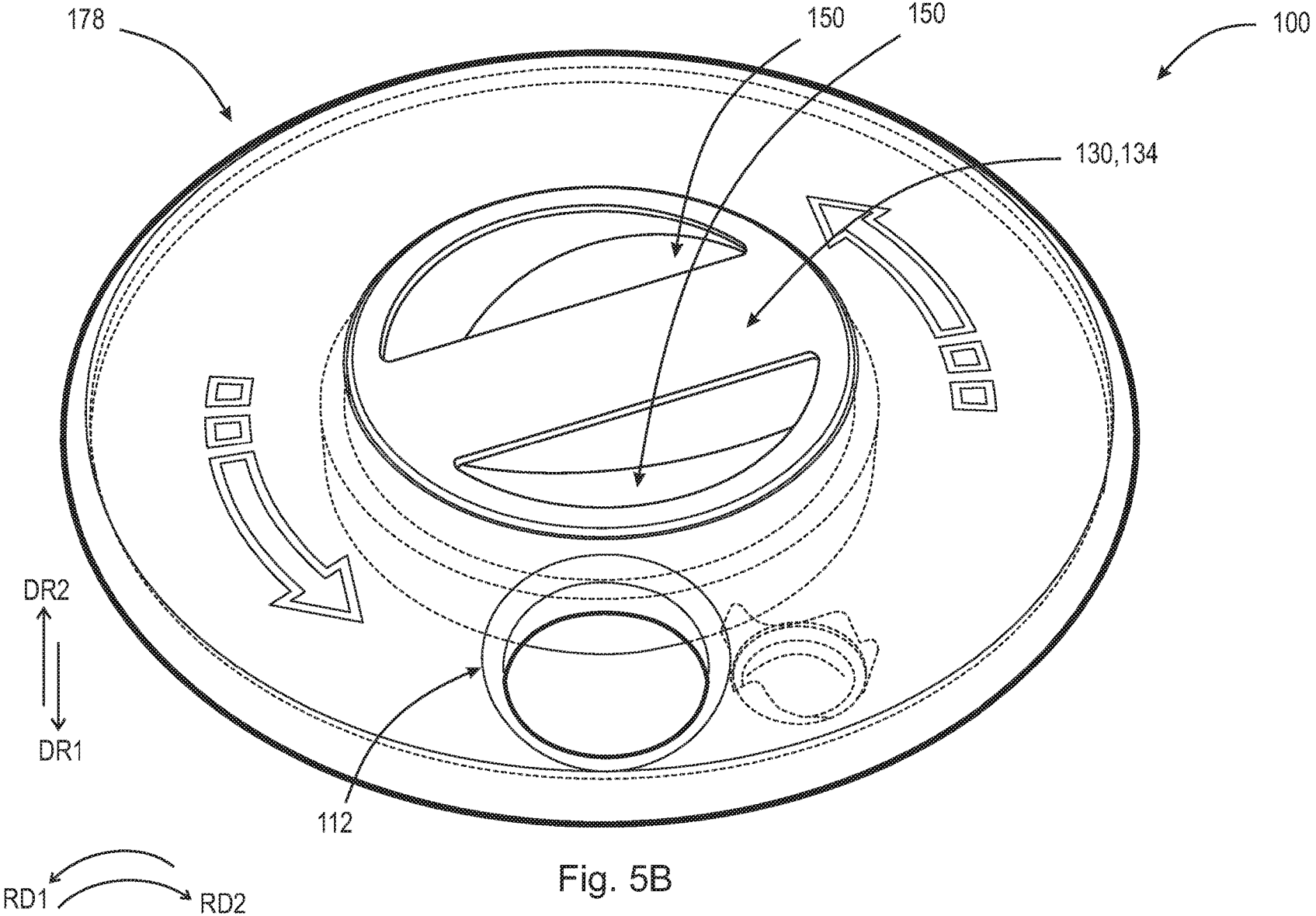
FIG. 5B is a front perspective view of the top of the dispensing assembly as disclosed herein.
Figure 5C:
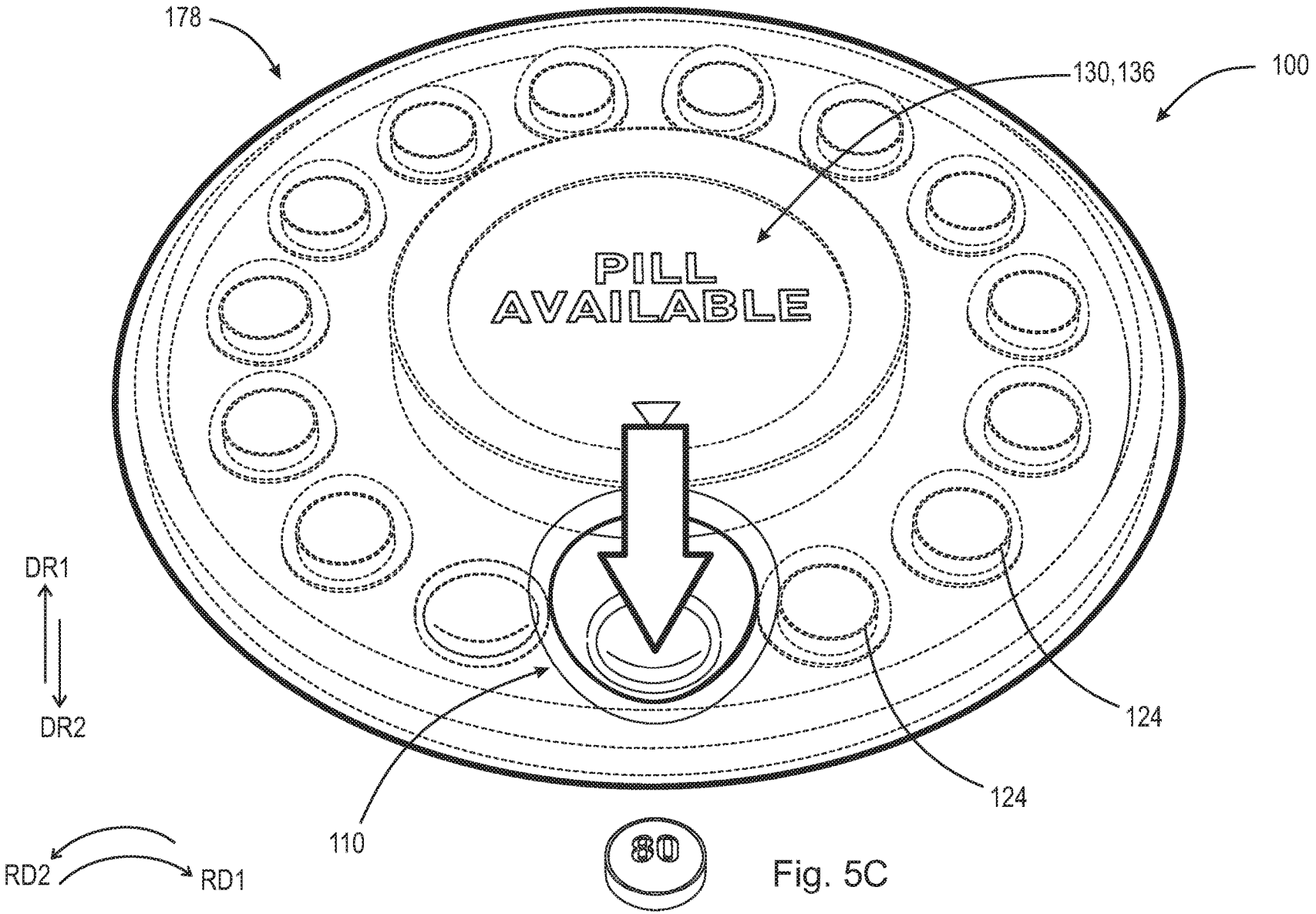
FIG. 5C is a front perspective view of the top of the dispensing assembly as disclosed herein.

To advance the dispensing assembly to second position 178, illustrated in FIGS. 5A-5C, the user engages with plurality of grips 150 disposed on second surface 148 of the second component 134 of lock 130. The user applies a rotational force in first rotational direction RIM. When sensor 169 indicates that tablet disc 122 has been rotated to second position 178. Activation of sensor 169 simultaneously causes solenoid actuator 152 to retract and timer 162 to activate, beginning a counting down proportional to first time interval 188 discussed infra. When solenoid actuator 152 is in the retracted state, pivotable catch 154 will engage with one of first plurality of teeth 116 of superior component 104 and prevent further rotational motion in second rotational direction RD2. Although not illustrated this may be accomplished with some biasing device, e.g., a spring, which biases pivotable catch 154 towards first plurality of teeth 116. Once in second position 178, a second tablet will be positioned and aligned with apertures 110 and 112 allowing the second tablet to be dispensed from dispensing assembly 100. At this point, the user must wait until the expiration of first time interval 188, for solenoid actuator 152 to engage with pivotable catch 154 and allow for rotation of tablet disc 122 to the next position. This process is repeated until all of the tablets of plurality of tablets 124 are utilized. Once the tablet disc is empty, the user can either dispose of the device, or return it to their healthcare provider for further analysis of usage discussed infra.

It should also be appreciated that the first pill/tablet slot of tablet disc 122 can be left empty, i.e., without a tablet present. This arrangement would be utilized in situations where a patient has been given a first dose of medication via a healthcare provider. In this situation, the healthcare provider or user would then rotate tablet disc 122 into second position 178 and trigger the countdown proportional to first time interval 188.

Figure 6A:
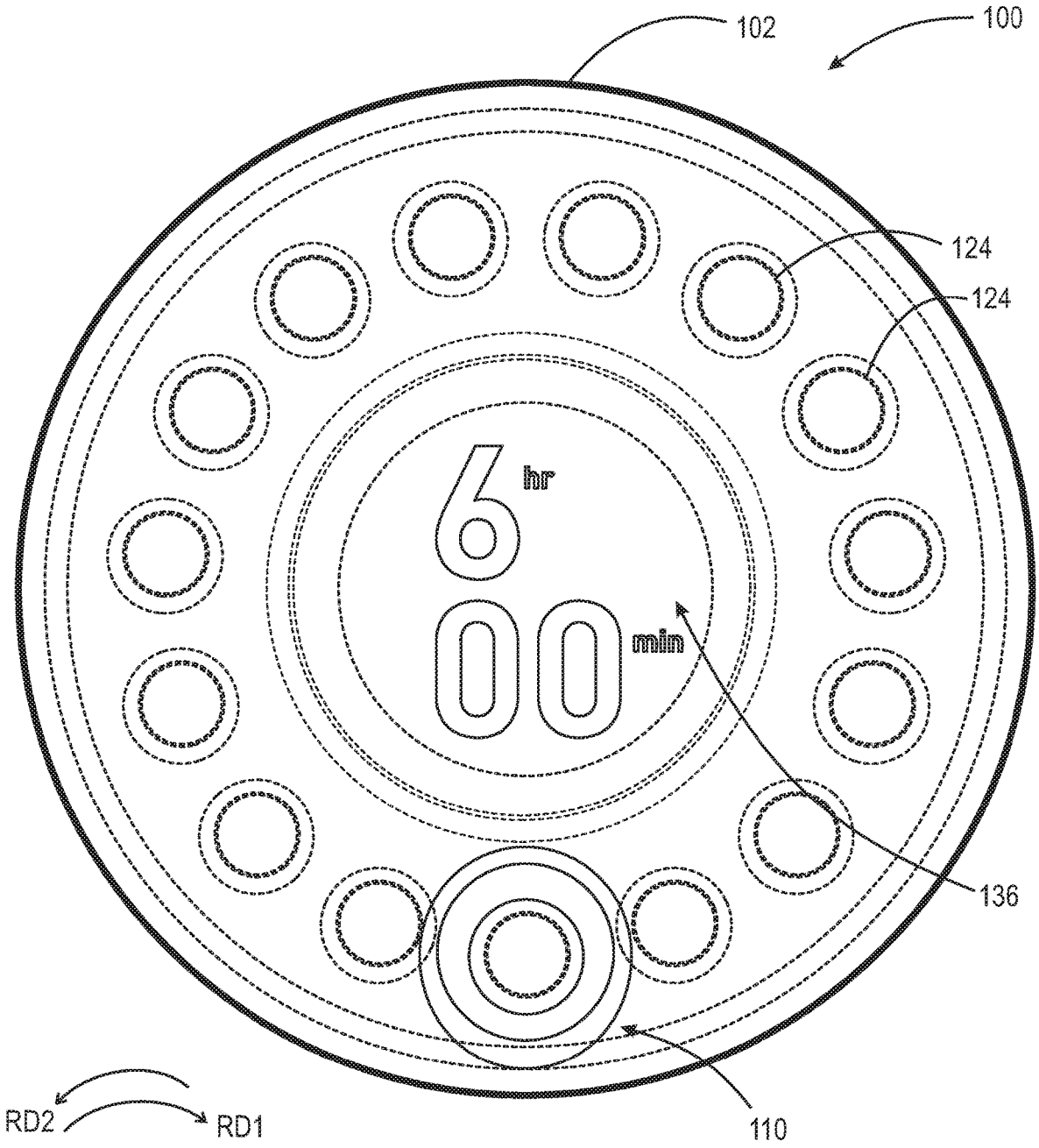
FIG. 6A is a top plan view of an example embodiment of a dispensing assembly as disclosed herein.
Figure 6B:
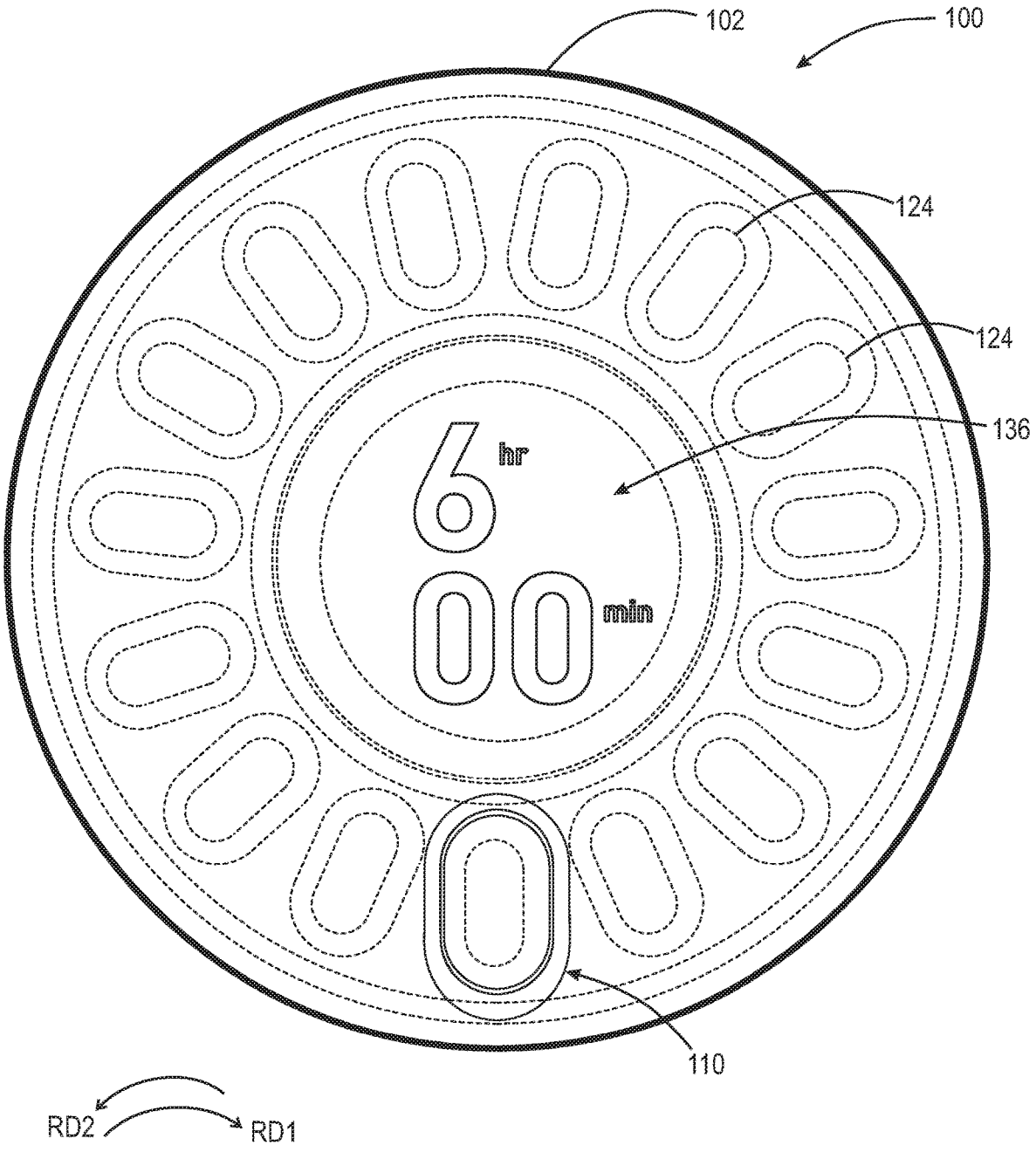
FIG. 6B is a top plan view of an example embodiment of a dispensing assembly as disclosed herein.

FIGS. 6A and 6B illustrate a top plan view of dispensing assembly 100. These views illustrate some of the potential variations in size and shape of tablets which can be utilized in tablet disc 122. The tablets of plurality of tablets 124 can be shaped as ovoid, cylindrical, triangular, or other suitable shape for ingestion. It should be appreciated that the variations shown are non-exhaustive of the potential sizes and shapes available. For example, any shape tablet can be used that can be pushed through apertures 110 and 112.

Figure 7:
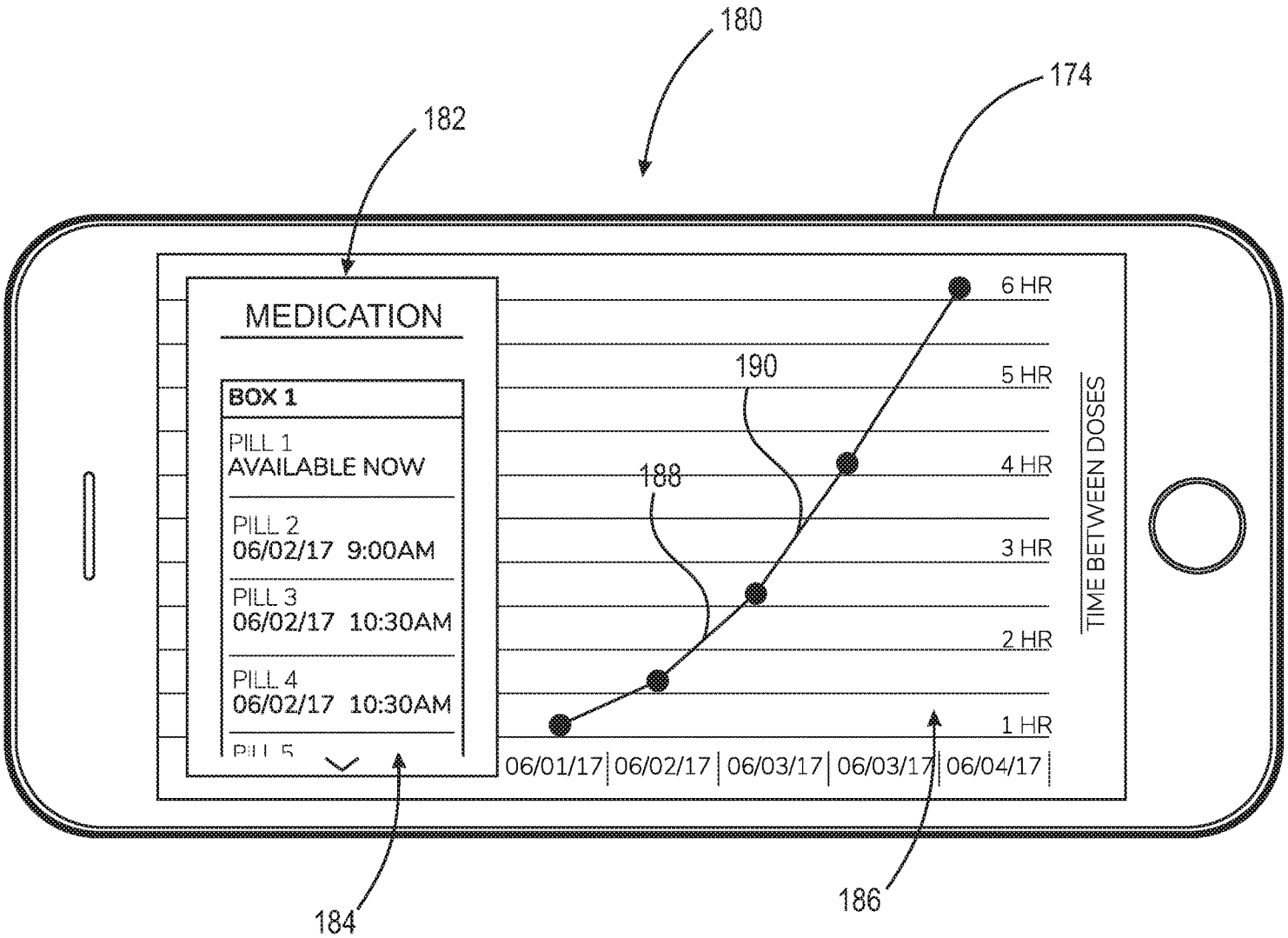
FIG. 7 is a schematic view of an example embodiment of the software interface arranged for communication with the dispensing assembly as disclosed herein; and, FIG. 8 is top plan view of an example embodiment of the dispensing assembly as disclosed herein.

FIG. 7 illustrates a schematic view of first computer 174 and software interface 180. First computer 174 and software interface 180 are arranged for communication with dispensing assembly 100. Software interface 180 is arranged to display first medication 182, list 184 arranged to show an organized list of the various dates and times each pill/tablet will become available, and graph 186 arranged to show a graphical illustration of the various dates and times recorded in list 184. In an example embodiment, first computer 174 is a smart phone; however, it should be appreciated that any other computer capable of sending and receiving wireless communications with antenna 164 can be used. First computer 174 is operatively arranged to receive/transmit wireless communications to and from antenna 164 discussed supra. First computer 174 may send an initial query to antenna 164, which query can be electrically transferred to microcontroller 160. Although not illustrated, it should also be appreciated that dispensing assembly 100 can communicate with first computer 174 via a wired connection, e.g., Ethernet cable, USB cable, or docking station. Microcontroller 160 can retrieve the data of the first data set, discuss supra, from memory 172 and transmit the first data set from antenna 164 to first computer 174 for display in software interface 180 of first computer 174. It should be appreciated that software interface 180 can be arranged to display more than one medication, e.g., a second medication, third medication, fourth medication simultaneously.

It should also be appreciated that multiple time intervals can be set by the pharmacist, manufacturer, or other healthcare provider, e.g., first time interval 188 and second time interval 190. First time interval 188 and second time interval 190 can be identical or they can be different e.g., the time between access to the first tablet and second tablet can be different than the time interval between the third tablet and fourth tablet. Additionally, the time intervals can vary e.g., the time between access to each tablet can range from days to seconds. It should further be appreciated that a final time period may be utilized in addition to first time interval 188 and second time interval 190. The final time period can be utilized to set a value of time, that when expired the device remains rotationally locked until accessed by the pharmacist, manufacturer, or other healthcare provider. For example, a final time period could be utilized in the event the dispensing assembly is used to administer doses of medication for clinical trials. If a clinical trial, having a set period of 10 days is established, the device may allow access to each tablet at predetermined time intervals in addition to locking the device permanently at the end of the ten day period. This will allow the administrators of the trial to gather evidence of a patient failing to take the medications at the prescribed time intervals.

FIG. 8 is top plan view of dispensing assembly 100 in an assembled state. In this view, the interaction between ratchet 158 and second plurality of teeth 156, as well as, the interaction between pivotable catch 154 and first plurality of teeth 116 can be seen. This view also illustrates the interaction between solenoid actuator 152 and pivotable catch 154, in that, the actuator plunger of solenoid actuator 152 sits within a notch arranged within pivotable catch 154.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

DR1 Direction
DR2 Direction
RD1 Rotational direction
RD2 Rotational direction
100 Dispensing assembly
102 Case
104 Superior component
106 Inferior component
108 First cavity
110 First aperture
112 Second aperture
114 First rim
116 First plurality of teeth
118 Opening
120 Second rim
122 Tablet disc
124 Plurality of tablets
126 First through-bore
128 Second through-bore
130 Lock
132 First component
134 Second component
136 Display
138 First circuit
140 First projection
142 First surface

144 Second cavity
146 Second projection
148 Second surface
150 Plurality of grips
152 Solenoid actuator
154 Pivotable catch
156 Second plurality of teeth
158 Ratchet
160 Microcontroller
162 Timer
164 Antenna
166 Power supply
168 Flex circuit
169 Sensor
170 Processor
172 Memory
174 First computer
176 Initial position
178 Second position
180 Software interface
182 First medication
184 List
186 Graph
188 First time interval
190 Second time interval

What is claimed is:

1. A tablet and capsule dispensing assembly, comprising:
a case including a radially inward facing surface having a first plurality of teeth;
a tablet disc having a plurality of tablets disposed circumferentially thereon, the tablet disc arranged to rotate within the case; and,
a lock arranged to engage with the first plurality of teeth to prevent rotation of the tablet disc during a first predetermined time interval.

2. The tablet and capsule dispensing assembly as recited in claim 1, wherein the lock is arranged to prevent rotation of the tablet disc during a second predetermined time interval, wherein the second predetermined time interval is equal to the first predetermined time interval.

3. The tablet and capsule dispensing assembly as recited in claim 1, wherein the lock is arranged to prevent rotation of the tablet disc during a second predetermined time interval, wherein the second predetermined time interval is not equal to the first predetermined time interval.

4. The tablet and capsule dispensing assembly as recited in claim 1, wherein the case further comprises:
a superior component; and,
an inferior component arranged to engage with the superior component forming a first cavity therebetween.

5. The tablet and capsule dispensing assembly as recited in claim 4, wherein the superior component comprises a first aperture and the inferior component comprises a second aperture, wherein the first aperture and the second aperture are arranged to allow a first tablet to be removed from the tablet disc.

6. The tablet and capsule dispensing assembly as recited in claim 4, wherein the superior component comprises the radially inward facing surface having the first plurality of teeth, wherein the first plurality of teeth are arranged to prevent rotational movement of the lock with respect to the case.

7. The tablet and capsule dispensing assembly as recited in claim 4, wherein the superior component and inferior component are made from Poly(methyl methacrylate), high-density polyethylene (HDPE), low-density polyethylene (LDPE), metal, high-impact polystyrene, Polycarbonate (PC), or Polyether Imide (PEI).

8. The tablet and capsule dispensing assembly as recited in claim 1, wherein the lock comprises:
a first component, the first component comprising:
a display and a first circuit electrically connected to the display; and,
a second component, the second component comprising:
a solenoid actuator;
a pivotable catch;
an outer circumferential surface including a second plurality of teeth; and,
a ratchet operatively arranged to engage with the second plurality of teeth and the case.

9. The tablet and capsule dispensing assembly as recited in claim 8, wherein the display is an E-ink display, a touch-screen display, a LED display, or a LCD display.

10. The tablet and capsule dispensing assembly as recited in claim 8, wherein the first circuit comprises:
a microcontroller including a first memory; and,
a timer, wherein the display, the microcontroller, the timer, and the solenoid actuator are all electrically connected.

11. The tablet and capsule dispensing assembly as recited in claim 8, wherein the second component further comprises a first surface, the first surface including:
a second cavity operatively arranged to receive the solenoid actuator; and,
at least one projection operatively arranged to engage a plurality of through-bores arranged in the tablet disc.

12. The tablet and capsule dispensing assembly as recited in claim 8, wherein the second component further comprises a second surface having one or more grips.

13. A tablet and capsule dispensing assembly, comprising:
a case including:
a superior component having a first aperture, the first aperture being entirely enclosed within the superior component; and,
an inferior component arranged to engage with the superior component forming a first cavity therebetween, the inferior component having a second aperture, the second aperture being entirely enclosed within the inferior component;
a tablet disc having a plurality of tablets disposed circumferentially thereon, the tablet disc arranged to rotate within the case, wherein the first aperture and the second aperture are arranged to, when aligned, allow a first tablet of the plurality of tablets to be removed from the tablet disc; and,
a lock arranged prevent rotation of the tablet disc in a first rotational direction-during a first predetermined time interval.

14. The tablet and capsule dispensing assembly as recited in claim 13, wherein the superior component further comprises a radially inward facing surface having a first plurality of teeth, wherein the first plurality of teeth are arranged to prevent rotational movement of the lock in the first rotational direction with respect to the case.

15. The tablet and capsule dispensing assembly as recited in claim 14, wherein the lock comprises:
a first component; and,
a second component, including:
an outer circumferential surface including a second plurality of teeth; and,
a ratchet operatively arranged to engage with the second plurality of teeth and the case.

16. The tablet and capsule dispensing assembly as recited in claim 15, wherein the second component further comprises a solenoid actuator and a pivotable catch.

17. The tablet and capsule dispensing assembly as recited in claim 15, wherein the first component comprises a display and a first circuit electrically connected to the display.

18. The tablet and capsule dispensing assembly as recited in claim 15, wherein the second component further comprises a first surface, the first surface including at least one projection operatively arranged to engage a plurality of through-bores arranged in the tablet disc.

19. The tablet and capsule dispensing assembly as recited in claim 16, wherein the second component further comprises a first surface, the first surface including a second cavity operatively arranged to receive the solenoid actuator.

20. The tablet and capsule dispensing assembly as recited in claim 17, wherein the first circuit comprises:

a microcontroller including a first memory; and, a timer, wherein the display, the microcontroller, and the timer are electrically connected.

* * * * *